United States Patent [19]

Viola et al.

[11] Patent Number: 4,558,994

[45] Date of Patent: Dec. 17, 1985

[54] DUAL STAGE AIR COMPRESSOR

[75] Inventors: Frank J. Viola, Uniondale; Erwin L. Schaub, Manhasset; Bernard C. Sharp, White Plains, all of N.Y.; Raymond J. Evans, Stratford, Conn.

[73] Assignee: Parker-Hannifin Corporation, Cleveland, Ohio

[21] Appl. No.: 627,328

[22] Filed: Jul. 2, 1984

[51] Int. Cl.[4] ..... F04B 49/00

[52] U.S. Cl. ..... 417/295

[58] Field of Search ..... 417/295, 559, 563; 137/855, 859

[56] References Cited

U.S. PATENT DOCUMENTS 1,126,613 1/1915 Brandstetter et al. ..... 417/295

2,741,424 4/1956 Ploeger ..... 417/295 X 4,193,424 3/1980 Hrabel ..... 137/855

4,382,749 5/1983 Teegarden et al. ..... 417/295

*Primary Examiner*—Richard E. Gluck

*Attorney, Agent, or Firm*—Joseph B. Balazs

[57] ABSTRACT

An electric motor driven portable air compressor consists of a reciprocating piston and cylinder arrangement with an intake throttling valve operative to unload the compressor above a predetermined pressure level. The throttling valve is a spring loaded plunger responsive to compressor output to close one of two inlet openings to reduce the charge of air in the cylinder. A stainless steel intake leaf spring is disposed between the cylinder and a two part die cast housing and is responsive to cylinder suction for control of the compressor.

8 Claims, 7 Drawing Figures

DUAL STAGE AIR COMPRESSOR

BACKGROUND OF THE INVENTION

This invention relates to air compressors and more particularly to a dual stage, electric motor driven, portable air compressor which is unloaded at the suction side above a predetermined pressure level.

Portable air compressors have come into vogue recently because of the lack of services at many gasoline stations. Most of these compressors are designed to deliver air at pressures in the range of 0–100 psi and accordingly compromises are made among the size of the motor and compressor and quantity of air that can be delivered in a given amount of time. Most prior art compressors have piston displacement sized in relation to the available power of the electric motor so that the motor is operating at or somewhat over its rated power when pumping against the 100 psi outlet pressure. This causes the motor to run under very modest load when pumping in the normal tire pressure range of 25–30 psi. With such low piston displacement, delivery rates are low, resulting in long filling times.

SUMMARY OF THE INVENTION

In this invention, piston displacement is sized so that the electric motor is substantially fully loaded at approximately 30 psi, providing fast inflation times for the most usual application for compressors of this type, i.e. automobile tire inflation. In order, however, to prevent the motor from being overloaded at higher pressure levels, a throttling valve is utilized to prevent the cylinder from receiving a full charge of air on the suction stroke. The throttling valve operates in an on—off mode, responsive to outlet pressure levels of the compressor, and serves to close the larger of two inlet orifices to the compressor. The small orifice, being on the order of one fifth the area of the larger orifice remains open throughout the operating range of the compressor and is sized so that the 100 psi level can be accommodated within the power range of the electric motor.

DESCRIPTION OF THE PREFERRED EMBODIMENT

Figure 1:
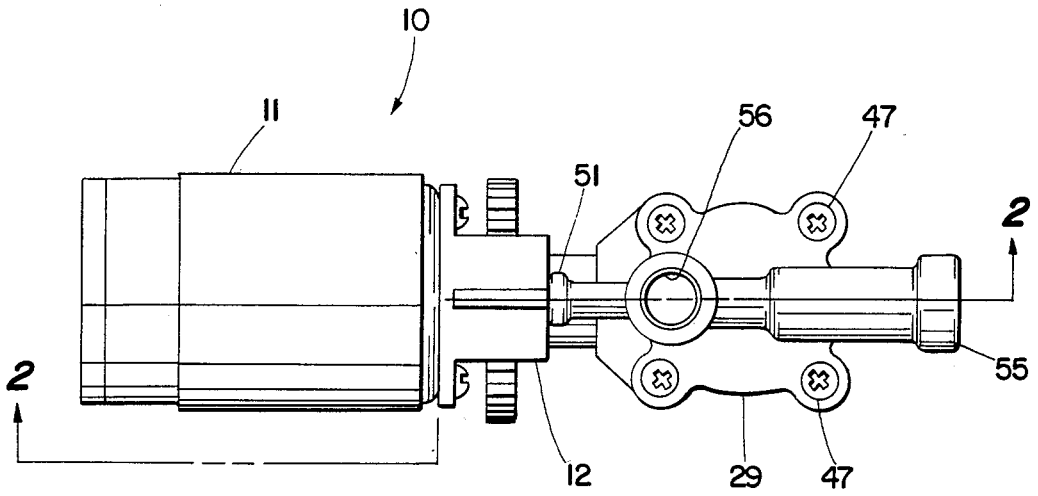
FIG. 1 is a plan view of the air compressor of the invention.

Referring now to the drawings, the air compressor 10 of the invention comprises electric motor 11, mounting bracket 12, cylinder 14 and housing 15, the latter containing most of the valving components for achieving the desired mode of operation of the compressor. The air compressor 10 is shown in the drawings partly in section and removed rom an enclosure which would shield the components thereof, for reasons of clarity.

Motor 11 is supported at one end in bracket 12 and has pinion gear 16 on its outer shaft. Motor 11 is typically a d.c. motor energized from an automobile battery or the like, by way of an accessory plug, and provides a relatively constant rate of rotation of pinion 16 when energized. Motor 11 is a fractional horsepower motor and typically would draw on the order of 13 or 14 amperes of current from a 12 volt battery source.

Pinion 16 is meshed with larger spur gear 18 in about a 4 or 5 to 1 gear reduction ratio. Gear 18 is fixed to one end of shaft 19, the latter being journaled for rotation on an axis parallel with the motor 11 axis, at the lower end of bracket 12. Flywheel 20 is fixed at the opposite end of shaft 19 for rotation therewith and has connecting rod pin 21 supported therein near the periphery.

The upper end of mounting bracket 12 has a laterally disposed platform 22 thereon which is apertured and bored to receive cylinder 14, the latter being a short length of tubular stock. Disposed in cylinder 14 is circular piston 24 which includes elastomeric piston cup 25 at its periphery, sealingly engaging the interior of cylinder 14. Piston connecting rod 26 connects piston 24 to flywheel 20 by way of the connecting pin 21 which is received in a bearing in the lower end of connecting rod 26. Thus it will be clear that piston 24 undergoes reciprocal movement in cylinder 14 upon rotation of flywheel 20 when rotated by motor 11 to suck air into and compress same in cylinder 14 when appropriately valved for this purpose.

Air compressor 10 is completed by housing 15 and the components therein. Housing 15 is a two part housing comprising generally circular plate cylinder head 28 and valve housing 29, both preferably being zinc die castings requiring little finish machining. Cylinder head 28 includes cylindrical bore 20 which provides a press fit for cylinder 14 and which terminates in end wall 27. Radial fins 31 are distributed about the periphery of cylinder head 28 for cooling purposes while an intake valve 32 is disposed in bore 30 between end wall 27 and cylinder 14. An opening through end wall 27 at one side of cylinder head 28 forms intake valve seat 34 and a second opening diametrically opposite thereto forms release valve seat 35. Cylinder head 28 further includes upstanding generally circular, thin wall bosses 36, 38 nested within one another which receive downwardly disposed respective bosses 40, 41 in a friction fit to secure the respective components and form chambers therein for fluid transfer. Boss 36 extends upwardly from end wall 27 and surrounds release valve seat 35 and forms outlet chamber 42, with annular seal 44 disposed between the upper end of boss 36 and valve housing 29. Depending boss 41 surrounds both intake valve seat 34 and release valve seat 35, but is excluded and isolated from the latter by boss 36, to form inlet chamber 37. Annular seal 46 is disposed between the lower end of boss 41 and cylinder head 28. Four bolts 47 secure valve housing 29 to cylinder head 28.

Valve housing 29 further includes outlet bore 50 terminating at one end in nipple 51 for interconnection to a fluid hose or the like and communicating at the other end with and partly coextensive with an intermediate sized valve bore 52. Valve bore 52 in turn communicates with and is partly coextensive with still larger inlet bore 54, the latter terminating at its outer end at inlet port 55. A threaded outlet port 56 communicates with outlet bore 50 and may receive a gauge for monitoring outlet pressure or may optionally be plugged. Outlet bore 50 further communicates with outlet chamber 42 by means of openings in the wall of valve housing 29, one of which is surrounded by a short depending boss 58 in line with release valve seat 35 to serve as a spring guide. Spring 59 which carries circular release valve 60 at its lower end in a biased closed condition against release valve seat 35 is supported on boss 58.

Figure 2:
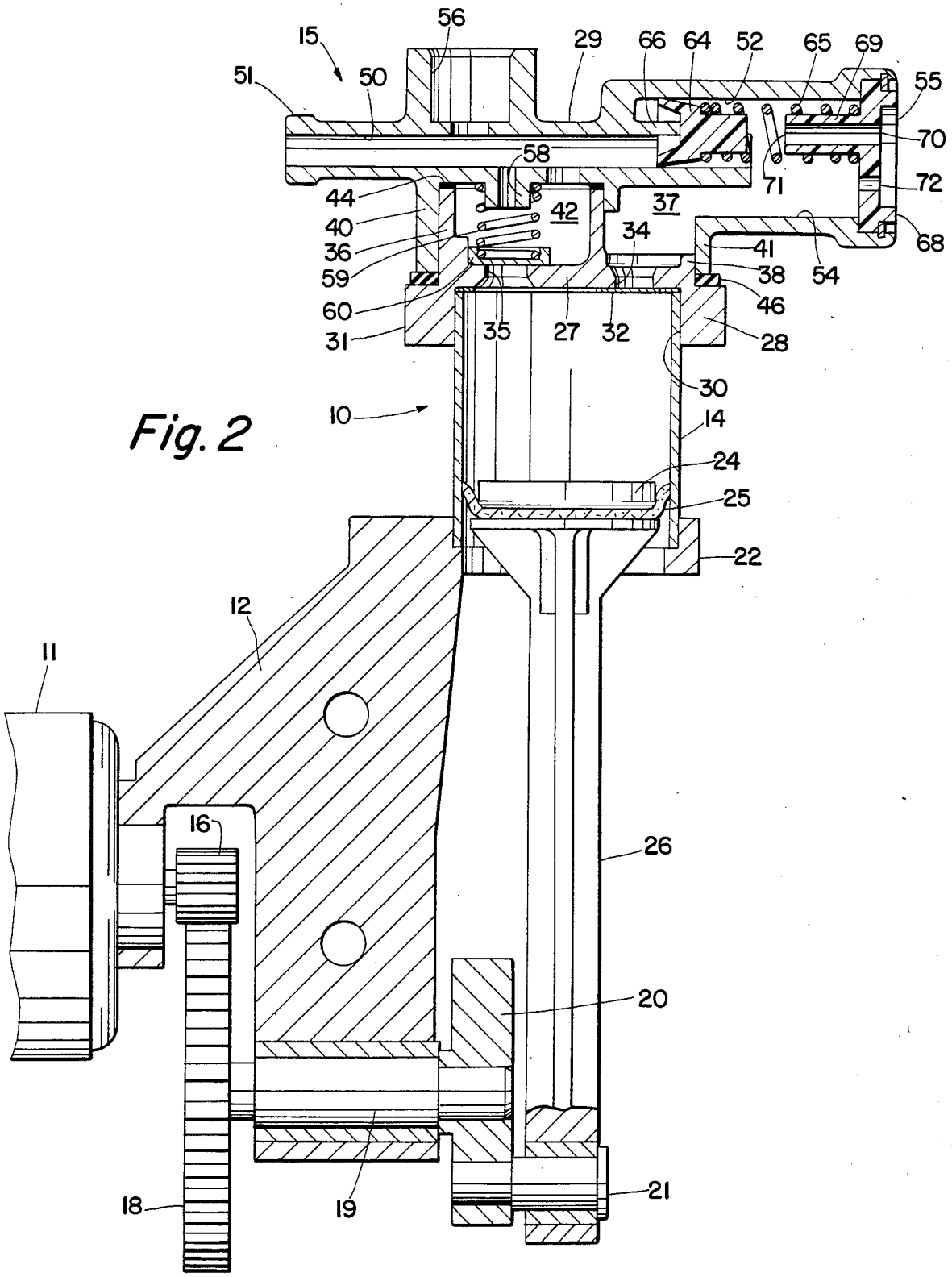
FIG. 2 is a view taken along the lines 2—2 of FIG. 1, showing a partial cross-sectional, elevational view of the air compressor.
Figure 3:
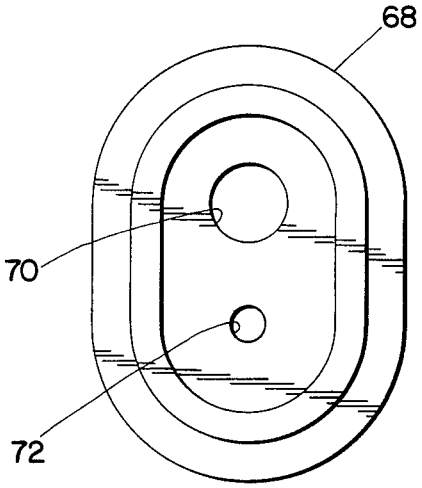
FIG. 3 is an enlarged end view of the inlet cap of the air compressor.
Figure 4:
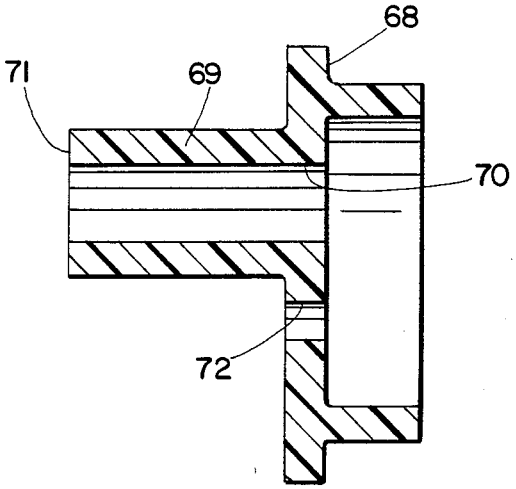
FIG. 4 is an enlarged cross-sectional view of the inlet cap shown in FIG. 3.

A throttling valve consisting of plunger 64 is disposed in bore 52 of valve housing 29 for control of inlet air to air compressor 19. Plunger 64 consists of a unitary elastomeric structure being cup-shaped at one end with an annular lip portion in sliding, sealing engagement with the wall of bore 52 and having a spring supporting and valve sealing cylindrical portion at the opposite end. Throttling spring 65 is axially disposed in bore 52 on the spring support portion of plunger 64 to urge plunger 64 to the left, as viewed in FIG. 2, against stop projection 66.

Valve housing cap 68 is disposed in sealing engagement in inlet port 55, being secured by a retaining ring or the like, and includes cylindrical boss 69 which serves as a guide for spring 65. Boss 69 is aligned with plunger 52 and includes central bore 70 therein extending through cap 68, forming at its inner end throttling valve seat 71. A second smaller inlet opening 72 is provided in cap 68 adjacent boss 69, opening 72 being on the order of one-fifth the area of the opening of bore 70. Inlet opening 72 as well as bore 70 are in fluid communication with inlet chamber 37, except when throttling valve plunger 64 is moved to the right into engagement with valve seat 71, thereby closing bore 70.

Figure 5:
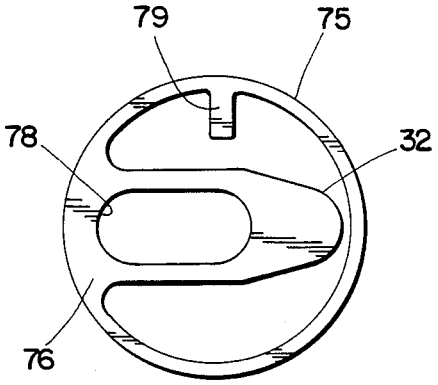
FIG. 5 is an enlarged plan view of the inlet value of the air compressor.

Intake valve 32 is best seen in FIG. 5 as comprising the leaf spring portion of a stamping of stainless steel which includes integral peripheral ring 75 surrounding and supporting valve 32 at the base end 76 thereof. Also at the base 76 of valve 32 is elongated aperture 78 which is disposed in alignment with release valve seat 35 so as not to affect the flow of air through valve seat 35. Tab 79 is provided for assuring proper positioning of aperture 78 and intake valve 32 and registers with an appropriate notch in cylinder head 28. The resilience of the metal forming intake valve 32 biases valve 32 against valve seat 34 to maintain the valve in a normally closed position, but the valve 32 is opened on the suction stroke of piston 24 to admit air to cylinder 14.

Thus, it may be understood that as air compressor 10 is actuated by energization of motor 11, piston 24 will be reciprocated within cylinder 14 in suction and compression strokes. On the suction stroke air will be drawn into inlet port 55, through bore 70 and inlet opening 72, to intake valve 32 thereby admitting a charge of air to cylinder 14. Release valve 60 is biased closed on this stroke but is forced open on the compression stroke to deliver compressed air to outlet chamber 42 and outlet bore 50. Intake valve 32 is biased closed on the compression stroke. As air pressure rises in outlet bore 50 to a predetermined level, throttling valve 62 will be moved into engagement with valve seat 71, thereby closing inlet bore 70. On succeeding suction strokes of piston 24, when outlet air pressure is above such predetermined level, throttling valve 64 will be held closed and inlet air will be delivered substantially only through inlet opening 72, resulting in a lesser volume charge of air being admitted to cylinder 14.

As noted, the area of bore 70 is larger than the area of opening 72. In the preferred embodiment of the invention, inlet opening 72 is 0.055 inch diameter and bore 70 is 0.125 inch diameter. Cylinder 14 is approximately 0.875 inch diameter while piston 24 undergoes a stroke of approximately 0.875 inches, resulting in a displacement on the order of 0.5 cubic inches.

Figure 6:
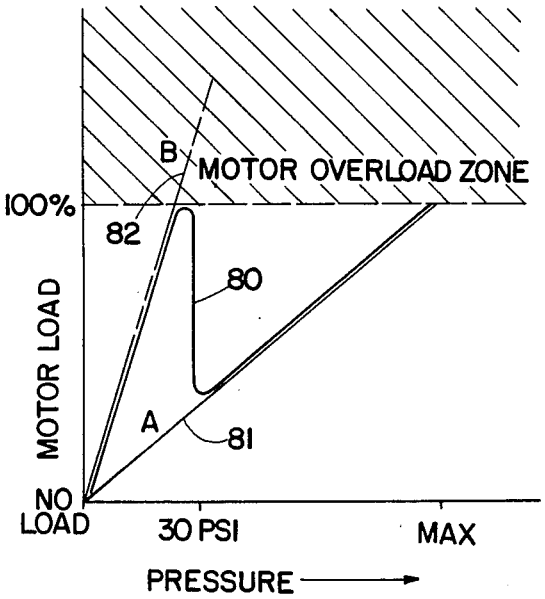
FIG. 6 is a graph plotting motor load against pressure for the air compressor of the invention.
Figure 7:
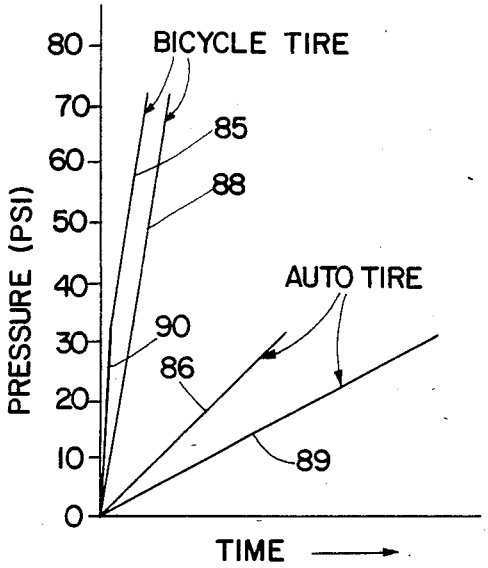
FIG. 7 is a graph plotting pressure against time for the air compressor of the invention.

Referring to the charts of FIGS. 6 and 7, the net effect of such dual stage operation of the air compressor 10 may be visualized. In FIG. 6, motor load is charted against outlet pressure. Curve 80 is representative of the air compressor 10 of the invention, while curves 81, 82 are representative of non-throttled air compressors which are designed to utilize maximum power of an available motor at a predetermined pressure level. Represented by curve 81 is the usual prior art compressor in which piston displacement is sized so that maximum motor load is achieved at or near the desired maximum pressure level output. At the lower end of curve 81 near the 30 psi point, it will be apparent that the motor is being operated at far less than its maximum loading, and thus not efficiently supplying a large volume of air. This is unfortunate since it is at such low pressure levels, when large quantities of air are usually required for inflation purposes.

Curve 82 represents an air compressor designed to have maximum motor loading at such lower pressure level of, for example, 30 psi. Much more efficient utilization is made of the motor at these levels, however, it is clear that such systems will not provide the higher pressure levels, because of motor overloading. It is seen that efficiency at the low pressure end as well as efficiency at the high pressure end is achieved by the air compressor 10 of the instant invention, as represented in curve 80. The dip in the curve occurring at approximately the 30 psi level is due to throttling valve 64 closing against valve seat 71 to restrict air intake on the suction stroke of piston 24. This unloads the motor 11 so that it may be operated to reach a maximum pressure output level in a second mode of operation.

FIG. 7 provides another indication of the advantages of this invention. Here curves 85, 86 represent the air compressor 10 of the invention while curves 88, 89 represent a prior art system as shown also by the curve 81 of FIG. 6. In FIG. 7, output pressure level is plotted against time of inflation for the two examples given. Thus, for inflation of a typical automobile tire the air compressor 10 of the invention, as shown by curve 86, would reach inflation pressure of about 30 psi considerably sooner than the compressor indicated by curve 89, since the latter is efficient only at higher pressure. However, even in a higher pressure example, such as for the bicycle tire, the air compressor 10 of the instant invention against reaches inflation pressure of about 70 psi sooner than the air compressor represented by curve 88. This is achieved because of the efficiencies of the dual mode of operation of the air compressor 10. As seen in the initial leg 90 of curve 85, a pressure level of about 30 psi is reached much sooner than in curve 88. Above the 30 psi level, both curve 85 and 88 increase at about the same rate. Initial leg 90 of curve 85 represents operation of air compressor 10 of the invention when throttling valve 64 is open and inlet air is received through inlet bore 70 and inlet opening 72 to substantially fully charge cylinder 14. The remainder of curve 85 represents operation of air compressor 10 when throttling valve 64 is closed and a reduced charge of air is delivered to cylinder 14.

I claim:

1. A dual stage throttled, portable air compressor, comprising:

a cylinder, a piston reciprocal within said cylinder, an electric motor, means interconnecting said motor and said piston for producing reciprocal movement of said piston, a housing in fluid communication with said cylinder, intake and release valves in said housing for controlling air flow into and out of said cylinder upon reciprocal movement of said piston, a throttling valve, operative when actuated to limit air flow to said intake valve, said throttling valve being actuated in response to outlet air pressure from said release valve above a predetermined level, said housing comprising a cylinder head supported on said cylinder and a valve housing supported on said cylinder head, said intake and release valves being cooperative with intake and release valve seats respectively in said cylinder head and said throttling valve being supported in said valve housing, and a cap forming one end of said valve housing, said cap having first and second openings therein, and a boss thereon forming a seat for said throttling valve, said first and second openings in said cap being in fluid communication with said intake valve for admitting inlet air to said cylinder, said throttling valve being operable when actuated to close said first opening to limit the flow of air to said intake valve, thereby reducing the charge of air in said cylinder.

2. The air compressor set forth in claim 1 wherein said throttling valve seat surrounds said first opening, said boss being disposed in line with a bore in said valve housing, said throttling valve comprising a plunger in said bore slidable into and out of engagement with said throttling valve seat, and a spring disposed on said boss and in engagement with said plunger for biasing said throttling valve to an open position.

3. The air compressor set forth in claim 2 wherein said bore is in fluid communication with said release valve.

4. The air compressor set forth in claim 3 wherein said intake valve comprises a sheet metal leaf spring disposed between said cylinder and said cylinder head and said leaf spring is biased into closed engagement with said intake valve seat.

5. The air compressor set forth in claim 4 wherein said leaf spring comprises a circular peripheral portion, and said leaf is disposed within said portion.

6. The air compressor set forth in claim 5 wherein said leaf spring is a stainless steel sheet metal stamping.

7. The air compressor set forth in claim 1 wherein said first opening is larger than said second opening.

8. The air compressor set forth in claim 7 wherein said first opening is on the order of five times the area of said second opening.

* * * * *